US005603607A

United States Patent [19]

Kondo et al.

[11] Patent Number: 5,603,607

[45] Date of Patent: Feb. 18, 1997

[54] PROPELLER FAN

[75] Inventors: Fumio Kondo; Masami Taniguchi, both of Nagoya; Masateru Hayashi; Akihiro Ito, both of Aichi-ken, all of Japan

[73] Assignee: Mitsubishi Jukogyo Kabushiki Kaisha, Tokyo, Japan

[21] Appl. No.: 555,050

[22] Filed: Nov. 8, 1995

[30] Foreign Application Priority Data

| | | | |
|---|---|---|---|
| Nov. 8, 1994 | [JP] | Japan | 6-273320 |
| Sep. 14, 1995 | [JP] | Japan | 7-236479 |

[51] Int. Cl.[6] ..... F04D 29/38

[52] U.S. Cl. ..... 416/228; 416/236 R; 415/119

[58] Field of Search ..... 415/119, 914; 416/228, 235, 236 R, 236 A; 181/225

[56] References Cited

U.S. PATENT DOCUMENTS

| | | | |
|---|---|---|---|
| 4,089,618 | 5/1978 | Patel | 416/236 A |
| 4,318,669 | 3/1982 | Wennerstrom . | |
| 4,441,857 | 4/1984 | Jackson et al. | 416/236 R |
| 4,640,668 | 2/1987 | Yang | 416/236 A |

FOREIGN PATENT DOCUMENTS

| | | | |
|---|---|---|---|
| 719758 | 2/1932 | France | 416/236 A |
| 2277257 | 1/1976 | France . | |
| 2546280 | 4/1977 | Germany . | |
| 3234011 | 3/1984 | Germany . | |
| 2-61400 | 3/1990 | Japan . | |
| 2105791 | 3/1983 | United Kingdom . | |

*Primary Examiner*—Edward K. Look
*Assistant Examiner*—Christopher Verdier
*Attorney, Agent, or Firm*—Birch, Stewart, Kolasch & Birch, LLP

[57] ABSTRACT

The present invention provides a propeller fan having a blade trailing edge of a sawtooth shape, in which the flows on the negative pressure side and the pressure side of a blade join gradually, so that the velocity loss is decreased in the vicinity of the trailing edge. As a result, the velocity gradient decreases and the generation of turbulence is reduced as compared with the conventional propeller fan, so that the noise is reduced and the fan efficiency is enhanced.

16 Claims, 13 Drawing Sheets

PROPELLER FAN

FIELD OF THE INVENTION AND RELATED ART STATEMENT

The present invention relates to a propeller fan used for a blower in an air conditioner and the like.

FIG. 14 is a configuration view showing the upper half of a propeller fan of prior art used in an air conditioner and the like. FIG. 14(*a*) is the front view, and FIG. 14(*b*) is the side view.

In FIG. 14, a propeller fan 1' has a plurality of blades 3' as shown in FIG. 14(*a*), which rotate in the direction of arrow A, and separated into the suction side and the discharge side by a bell mouth (or orifice) casing 2 as shown in FIG. 14(*b*). Reference numeral 3*a*' in FIG. 14 denotes a trailing edge of the blade 3'.

The propeller fan of this type is often used in an outdoor unit for an air conditioner or in a ventilating fan. Therefore, low noise, light weight, and compactness of the propeller fan are demanded. Normally, the propeller fan is made of plastic material and formed into a sheet shape. It is required that the blades be generally of an arcuate shape and have a substantially uniform thickness, that the adjacent blades do not overlap with each other, and that the productivity of propeller fan be high.

The noise generated from the propeller fan is broadly divided into wideband noise and discrete frequency noise. The former noise is dominant in a low-pressure fan for an air conditioner and the like. The wideband noise is generated by the upper stream turbulence, the pressure variation on the blade surface, and the vortexes discharged from the blade trailing edge. Therefore, to reduce the wideband noise, the chord length C (refer to FIG. 10) should be made as long as possible to decrease and distribute the wing load, and the accumulation of boundary layer at the blade trailing edge should be decreased by the forward inclination.

In recent years, the level of demand for low noise has been increased. To meet this demand, the above measures are insufficient. To further reduce the noise from the propeller fan, other measures have been needed. Among the aforementioned main causes of (a) upper stream turbulence, (b) trailing vortexes, and (c) pressure variation on blade surface for the generation of wideband noise from the propeller fan, the trailing vortexes of (b) contribute greatly to the noise when the upper stream turbulence of (a) is low. Therefore, one possible measure for reducing noise is to decrease the trailing vortexes discharged from the blade trailing edge by adopting an aerofoil-shaped cross section of blade, eliminating the flow variation on the blade surface and decreasing the trailing edge thickness.

However, if the cross section of blade is formed into a thick aerofoil shape, the weight of propeller fan is increased, and the cost thereof is raised. Also, considering the sink in resin molding, the limited mold thickness for mass production is present, so that the aerofoil-shaped fan is difficult to be used practically, leading to the limitation in lowering the noise.

OBJECT AND SUMMARY OF THE INVENTION

Accordingly, an object of the present invention is to provide, in view of the above prior art, a propeller fan which achieves lower noise and facilitates practical use.

The first mode of the present invention to solve the above problems is characterized in that a blade trailing edge is in a sawtooth shape.

The second mode of the present invention to solve the above problems is characterized in that a blade trailing edge is in a sawtooth shape having continuous teeth of the same shape.

The third mode of the present invention to solve the above problems is characterized in that a blade trailing edge is in a sawtooth shape having teeth of sequentially changed size from a larger tooth to a smaller tooth.

The fourth mode of the present invention to solve the above problems is characterized in that a blade trailing edge is in a sawtooth shape having teeth with different angles combined appropriately.

The fifth mode of the present invention to solve the above problems is characterized in that the sawteeth are in a triangular shape in the above first, second, third, or fourth mode.

The sixth mode of the present invention to solve the above problems is characterized in that tooth tips of the sawteeth are rounded in the above fifth mode.

The seventh mode of the present invention to solve the above problems is characterized in that the roundness of the tooth tip has a radius R of 50% or less of the tooth pitch or the tooth height in the above sixth mode.

The eighth mode of the present invention to solve the above problems is characterized in that H/D is nearly equal to 0.02 and S/D is nearly equal to 0.02, where H is a tooth height, S is the tooth pitch, and D is the propeller fan diameter of the shape parameter of the sawtooth in the above first, second, third, or fourth mode.

The ninth mode of the present invention to solve the above problem is characterized in that $0.5 \leqq S/H \leqq 2$ where H is the tooth height and S is the tooth pitch of the shape parameter of the sawtooth in the above first, second, third, or fourth mode.

Therefore, according to the present invention of the above first, second, third, fourth, fifth, sixth, seventh, eighth, or ninth mode, because of the sawtooth shaped blade trailing edge, the flows on the negative pressure side and the pressure side of the blade join gradually, and the joining (mixing) of the flows is carried out smoothly. Therefore, the vortexes created by the joining of the flows are made fine, and the velocity loss caused by the joining of the flows decreases. As a result, the noise produced by the joining of the flows is reduced, and the fan efficiency is enhanced.

More particularly, the flow along the blade surface has a higher flow velocity on the upper surface having a larger warp of blade, constituting a negative pressure flow, and constitutes a positive pressure flow on the lower surface having a smaller warp of blade with the blade surface being a boundary. These two flows mix in the process of flowing apart from the trailing edge of the blade. The two-dimensional vortexes produced at this time cause noise, or cause the decrease in fan efficiency due to pressure loss.

Contrarily, according to the present invention of the above first to ninth mode, because of the sawtooth shape of the blade trailing edge, a leak flow going from the positive pressure zone to the negative pressure zone is produced at the notch portion of sawtooth. This leak flow forms longitudinal vortexes symmetrical with respect to the blade cross section passing through the bottom of the notch. The velocity component of this longitudinal vortex is synthesized to the velocity component of the main flow along the blade surface. The flow going through the blade end turns to a spiral flow, by which mixing is accelerated. Because the turbulence of flow in the mixing zone decreases, the generation of noise is reduced as compared with the conventional propeller fan which produces two-dimensional vortexes, and the fan efficiency is enhanced.

The models of this explanation are shown in FIGS. 6(*a*) and 6(*b*). In FIG. 6(*a*), arrow F indicates the flow direction. In FIG. 6(*b*), arrow K indicates the leak flow. Reference character P denotes a pressure surface, N denotes a negative pressure surface, SA denotes a serration crest, and SB denotes a serration valley. Typical simulation of this explanation is shown in FIGS. 7(*a*) and 7(*b*). FIG. 7(*a*) shows a simulated secondary flow in the cross section traversing the sawteeth of blade, while FIG. 7(*b*) shows a simulated secondary flow in the mixing zone a predetermined distance apart from the sawteeth of the blade.

As described above, and as explained in detail in the embodiment, described later, according to the present invention, because of the sawtooth shape of blade trailing edge, the noise can further be reduced as compared with the conventional propeller fan, and the fan efficiency can be enhanced. In addition, the practical use is easy.

Also, because of the rounding of the tooth tip of sawtooth, the noise can further be reduced, and the production of sink, burr, and the like can be decreased in molding the propeller fan.

BRIEF DESCRIPTION OF THE DRAWINGS

FIG. 6(*a*) is a view for illustrating the blade trailing edge and the blade joint flow, particularly the longitudinal vortexes, and FIG. 6(*b*) is a view for illustrating the flow going in the notch portion (valley portion) from the positive pressure zone to the negative pressure zone;

FIG. 7(*a*) shows a flow pattern of secondary flow in the cross section taken along the line A—A of FIG. 6(*a*), and FIG. 7(*b*) shows a flow pattern of secondary flow in the cross section taken along the line B—B of FIG. 6(*a*);

FIGS. 14(*a*) and 14(*b*) are configuration views showing the upper half of a propeller fan in accordance with prior art used in an air conditioner and the like.

DETAILED DESCRIPTION OF PREFERRED EMBODIMENTS

Figure 14A:
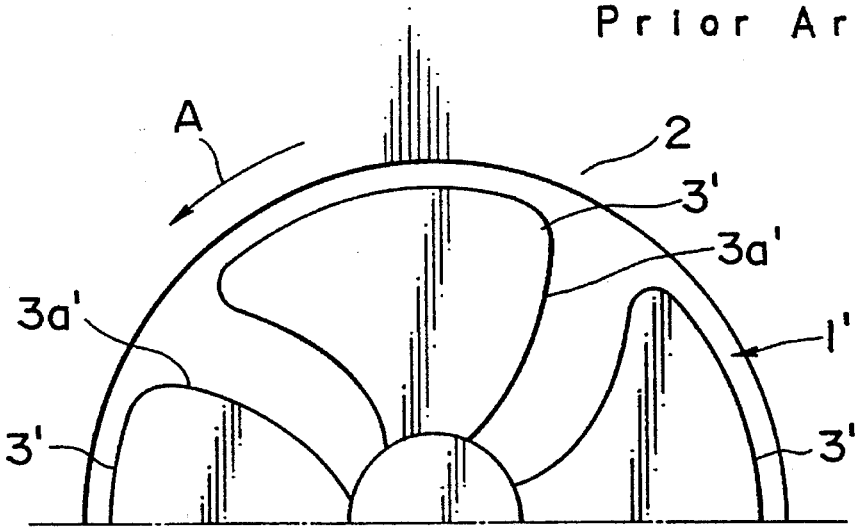
FIG. 14(a) Prior Art
Figure 14B:
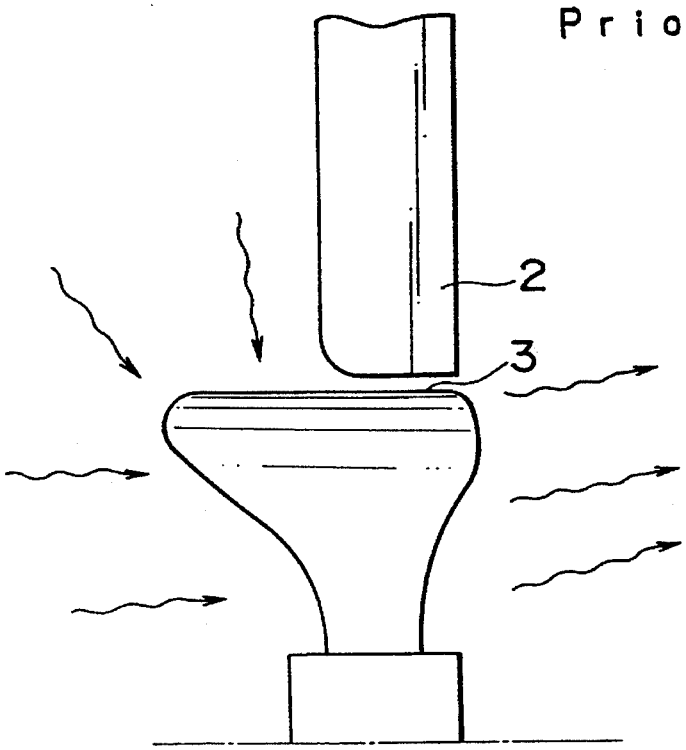
FIG. 14(b) Prior Art

The mode of the embodiment in accordance with the present invention will be described below in detail with reference to the drawings. The same reference numerals are applied to the elements similar to those in FIG. 14, and the duplicated explanation is omitted.

Figure 1:
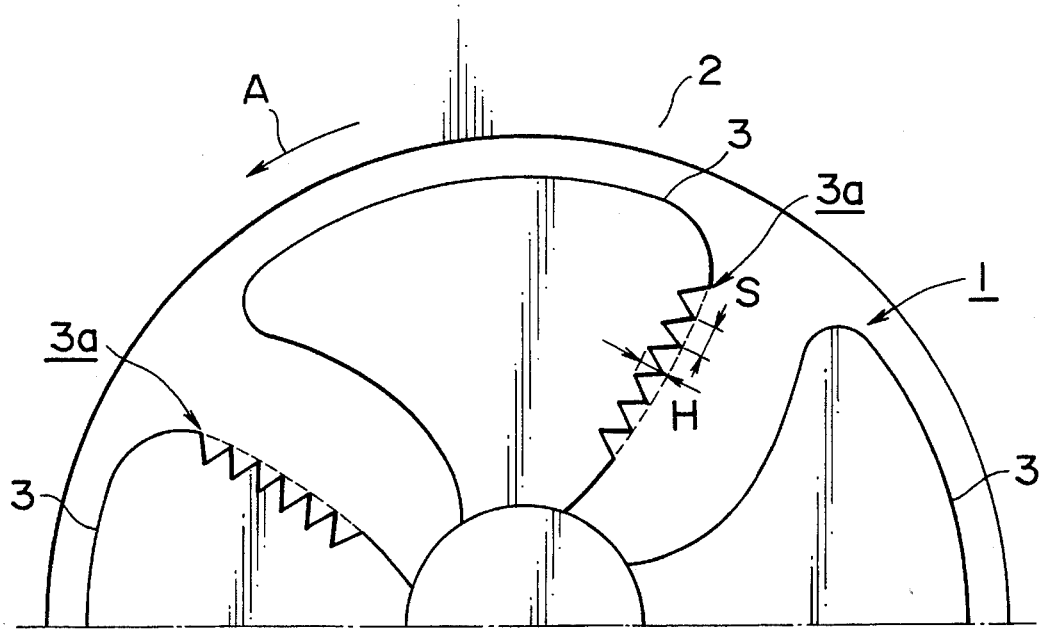
FIG. 1 is a configuration view showing the upper half of a propeller fan in accordance with an embodiment of the present invention.
Figure 2:
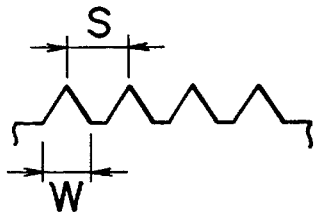
FIG. 2 is a view showing another shape of sawtooth.

FIG. 1 is a configuration view showing the upper half of a propeller fan in accordance with an embodiment of the present invention. As shown in this figure, a propeller fan 1 in accordance with this embodiment has a plurality of blades 3 disposed with a predetermined gap in the circumferential direction. The trailing edge 3*a* of each blade 3 is formed into a sawtooth shape. The broken line in FIG. 1 indicates the conventional shape of trailing edge (refer to FIG. 14). FIG. 1 shows an example in which tooth pitch S is equal to the tooth width (tooth pitch=tooth width). However, the tooth pitch S is sometimes larger than the tooth width W (tooth pitch>tooth width) as shown in FIG. 2.

The performance of the propeller fan 1 thus configured will be described with reference to FIGS. 3, 4, and 5.

Figure 3A:
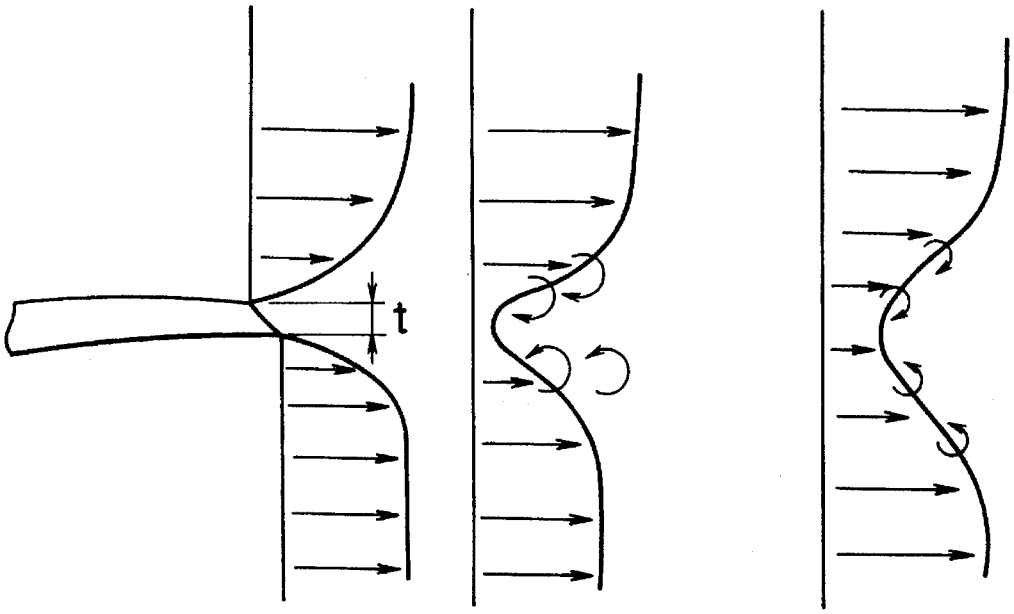
FIGS. 3(*a*) and 3(*b*) are views for comparing velocity patterns at the blade trailing edge between the case where the blade trailing edge is in a sawtooth shape and the case where it is not in a sawtooth shape (conventional case)
Figure 3B:
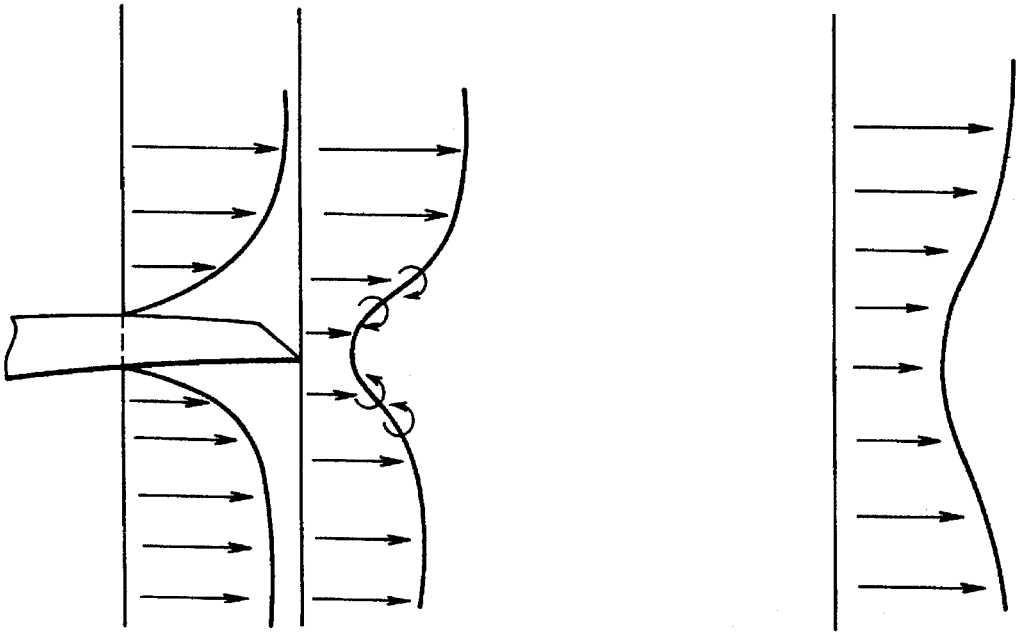

FIG. 3 is a view for comparing velocity patterns at the blade trailing edge between the case where the blade trailing edge is in a sawtooth shape and the case where it is not in a sawtooth shape (conventional case). When the blade trailing edge is not in a sawtooth shape, the flows on the negative pressure surface side and the pressure surface side of blade join at the blade trailing edge as shown in FIG. 3(*a*), but a high velocity loss occurs immediately after the joining of flows because of the presence of thickness t of blade trailing edge. At this velocity loss portion, the velocity difference between the adjacent fluids is large (velocity gradient is great), so that a great turbulence occurs. This turbulence causes the lift variation of the whole blade, generating high noise.

On the other hand, when the blade trailing edge is in a sawtooth shape, the flows begin to join gradually at the sawtooth portion as shown in FIG. 3(*b*), and have joined considerably in the vicinity of the trailing edge, resulting in reduced velocity loss. For this reason, the velocity gradient decreases as compared with the above case, by which the generation of turbulence is decreased, resulting in lower noise. At the same time, since the velocity loss portion of the joining portion decreases, the mixing loss decreases, so that the fan efficiency is enhanced.

Figure 4:
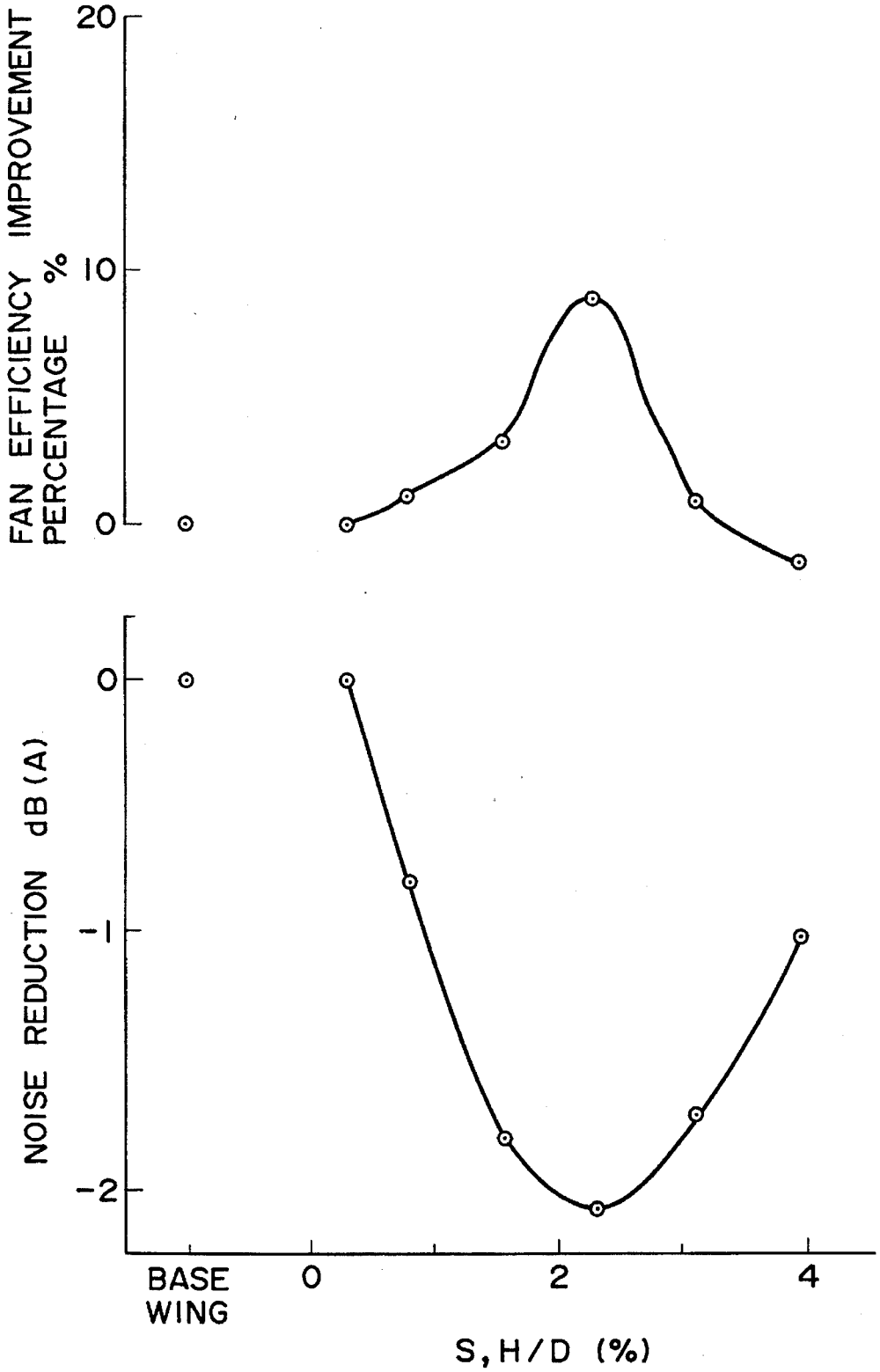
FIG. 4 is a characteristic diagram showing the effect of the size of tooth of blade trailing edge on the fan performance (noise reducing characteristics and fan efficiency characteristics)

FIG. 4 is a characteristic diagram showing the effect of the size of tooth of blade trailing edge on the fan performance. In this figure, the abscissae represent the ratio of tooth height H and tooth pitch S (refer to FIG. 1, here H=S) to outside diameter D of a propeller fan 1, and the ordinates represent the noise reduction and the fan efficiency improvement percentage. As seen from this figure, in the range of H, S/D=1–4%, the noise decreases by 1 dB(A) or more and the fan efficiency is enhanced. The peak lies at a point where H, S/D is about 2%.

Figure 5:
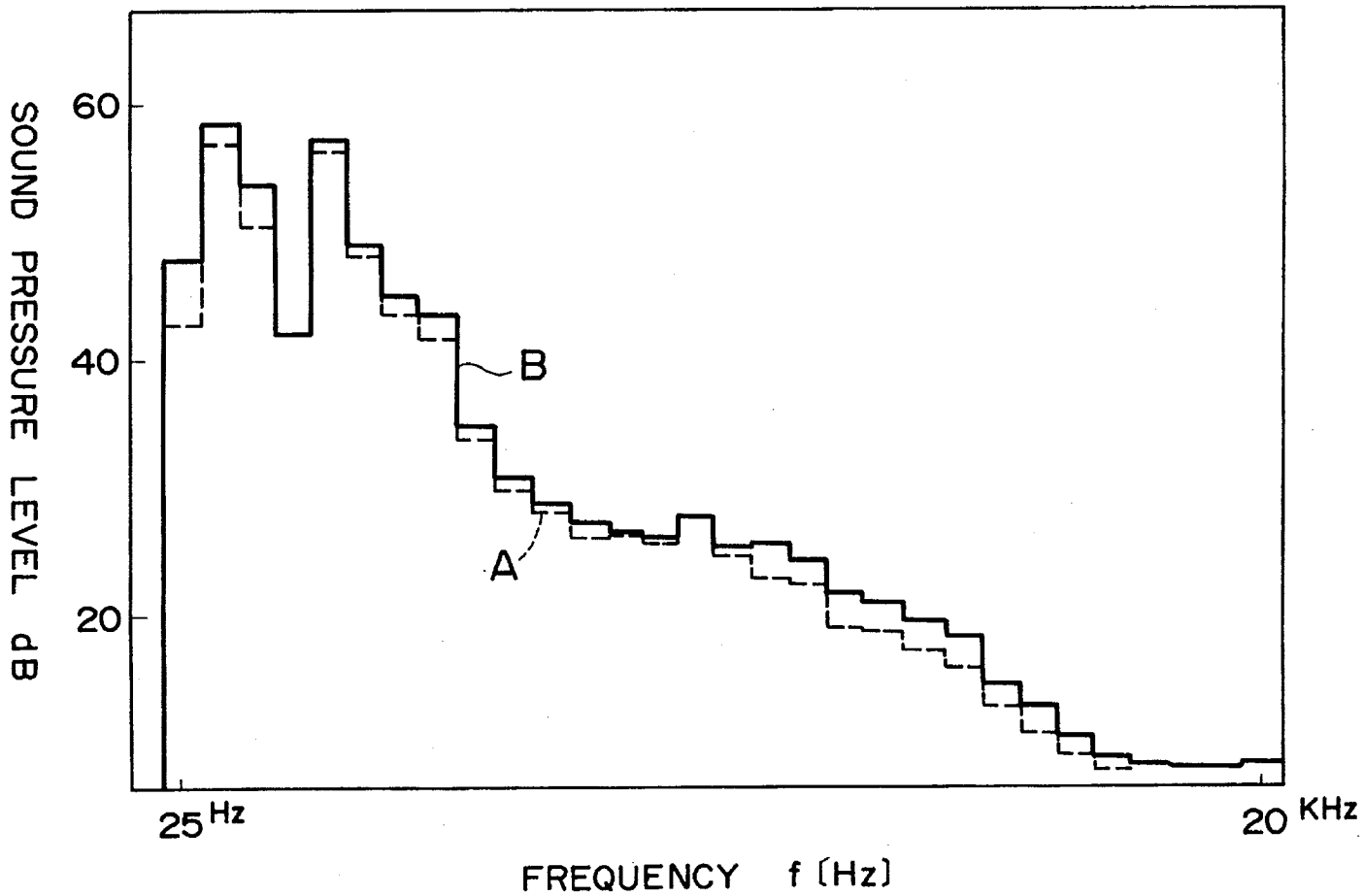
FIG. 5 is a characteristic diagram for comparing the noise analysis results between the case where the blade trailing edge is in a sawtooth shape and the case where it is not in a sawtooth shape (conventional case)

FIG. 5 is a characteristic diagram for comparing the noise analysis results between the case where the blade trailing edge is in a sawtooth shape and the case where it is not in a sawtooth shape (conventional case). In this figure, the abscissae represent frequency f, and the ordinates represent sound pressure level dB. The broken line A in this figure indicates the case where the blade trailing edge is in a sawtooth shape, while the solid line B indicates the case where the blade trailing edge is not in a sawtooth shape. As seen from this figure, when the blade trailing edge is in a sawtooth shape, the noise level (sound pressure level) decreases in a wide range as compared with the case where the blade trailing edge is not in a sawtooth shape.

The above description is a conclusion obtained from the result of experiment performed under the condition of the propeller fan speed of $U_\infty$=14.5 m/s for the propeller fan dimensions of D=394 mm in dia, C=0.25 m, and S/H=1.0.

To understand this phenomenon more accurately, the simulation of flow pattern of secondary flow was performed, and the shape parameter change characteristics of sawtooth were determined under the above condition.

Figure 6A:
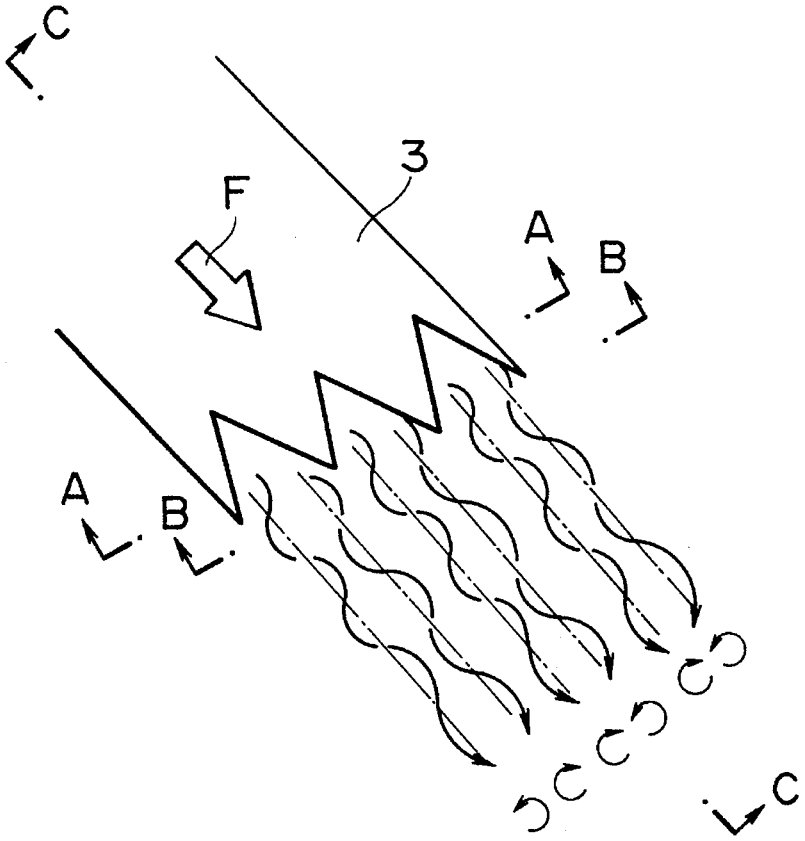
FIGS. 6(*a*) and 6(*b*) are model views for illustrating the flow.
Figure 6B:
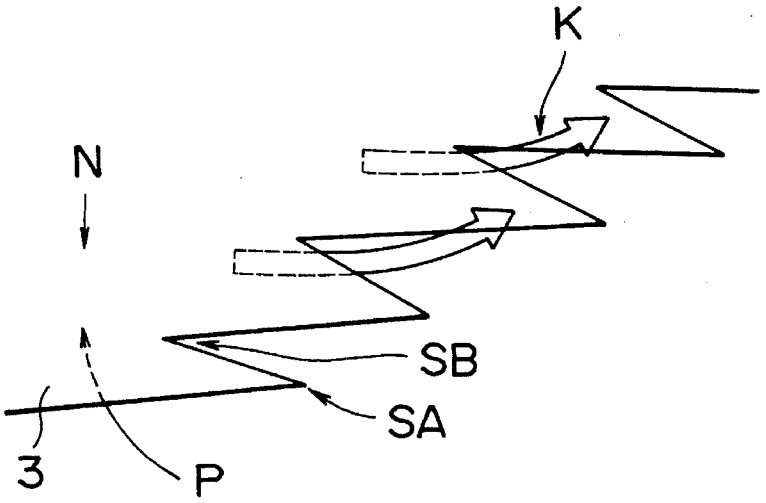
Figure 7A:
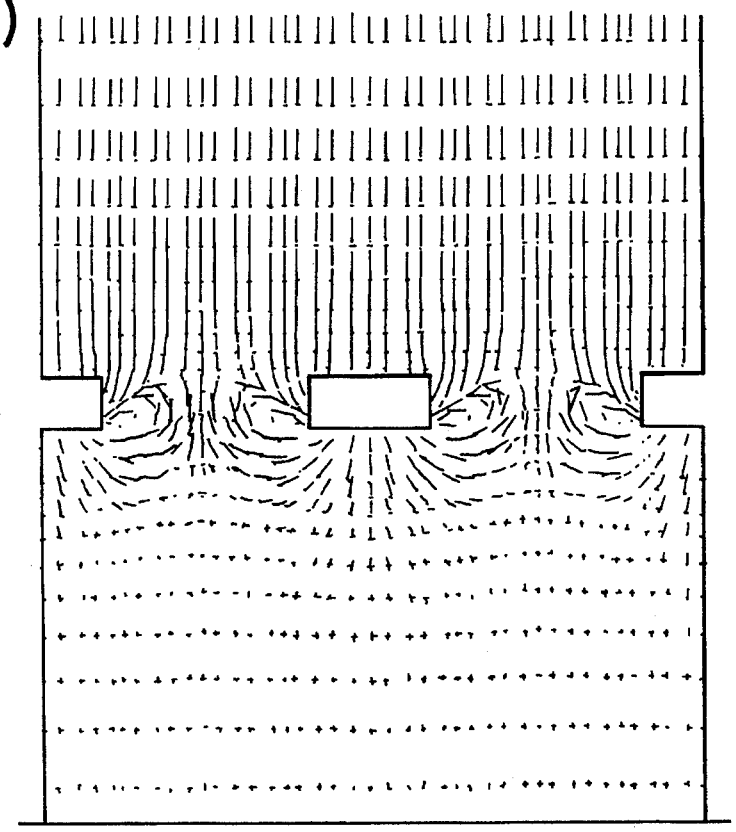
FIGS. 7(*a*) and 7(*b*) are views showing a flow pattern of secondary flow at the blade trailing edge obtained by simulation.
Figure 7B:
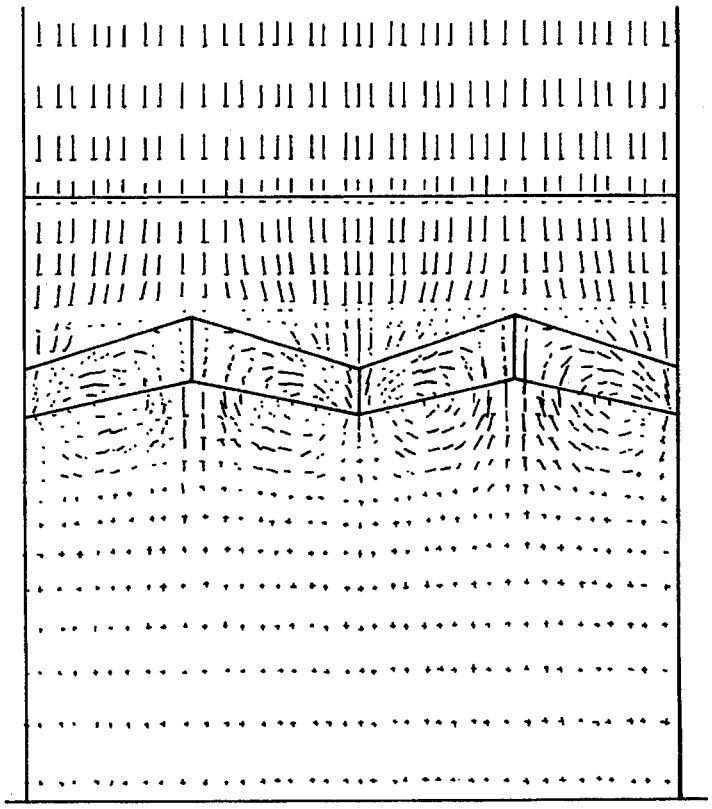
Figure 10:
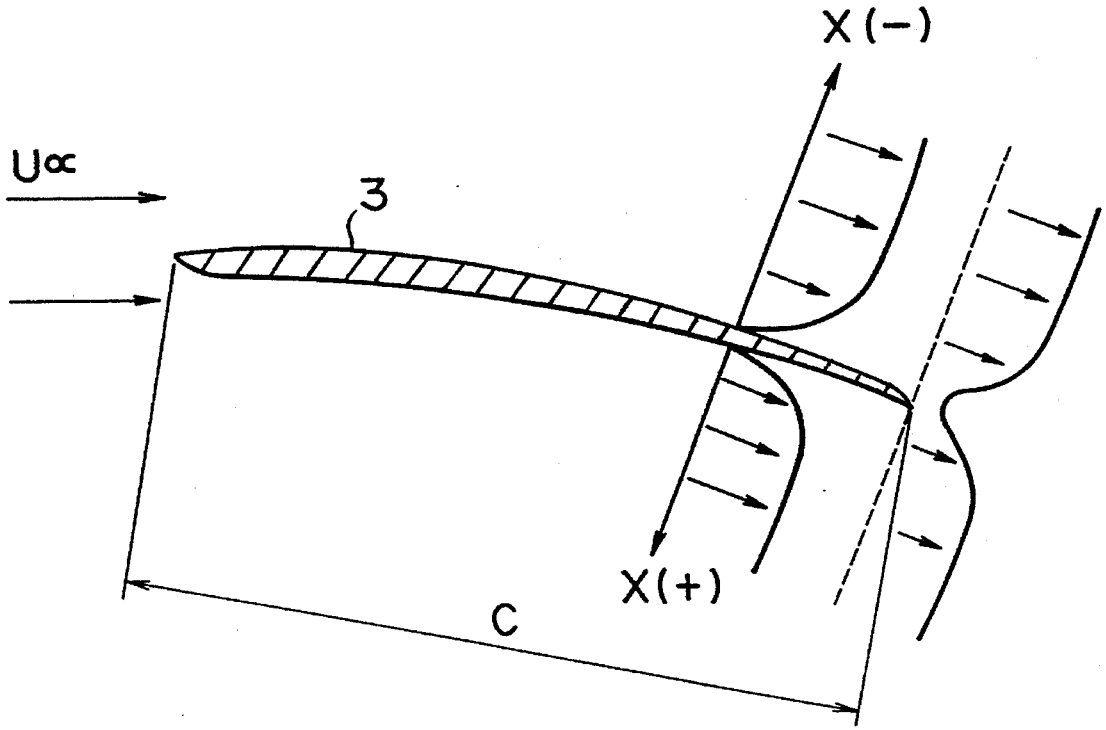
FIG. 10 is a view showing the cross section taken along the line C—C of FIG. 6(*a*)

FIGS. 7(*a*) and 7(*b*) show the results of simulation of the flow pattern of secondary flow at the blade trailing edge. FIG. 7(*a*) shows a flow pattern of secondary flow in the cross section taken along the line A—A of FIG. 6(*a*), and FIG. 7(*b*) shows a flow pattern of secondary flow in the cross section taken along the line B—B of FIG. 6(*a*). These figures show the result of determination of distribution of magnitudes and directions of velocity components in the cross section of the flow along the blade. FIG. 6(*a*) is a view for illustrating the blade trailing edge and the blade joint flow, particularly the longitudinal vortexes, and FIG. 6(*b*) is a view for illustrating the flow going in the notch portion (valley portion) from the positive pressure zone to the negative pressure zone. FIG. 10 shows the flows on the pressure side and on the negative pressure side in the cross section taken along the line C—C of FIG. 6(*a*).

From FIG. 7(*a*), it is found that at the valley portion of the sawtooth, a flow going from the positive pressure zone (lower part of the drawing) to the negative pressure zone (upper part of the drawing) is generated, and longitudinal vortexes symmetrical with respect to the cross section passing through the valley bottom is generated. Also, from FIG. 7(*b*), it is found that in the flow apart from the blade trailing edge, the longitudinal vortexes symmetrical with respect to the cross section passing through the valley bottom of the sawtooth develops more perfectly.

Figure 8:
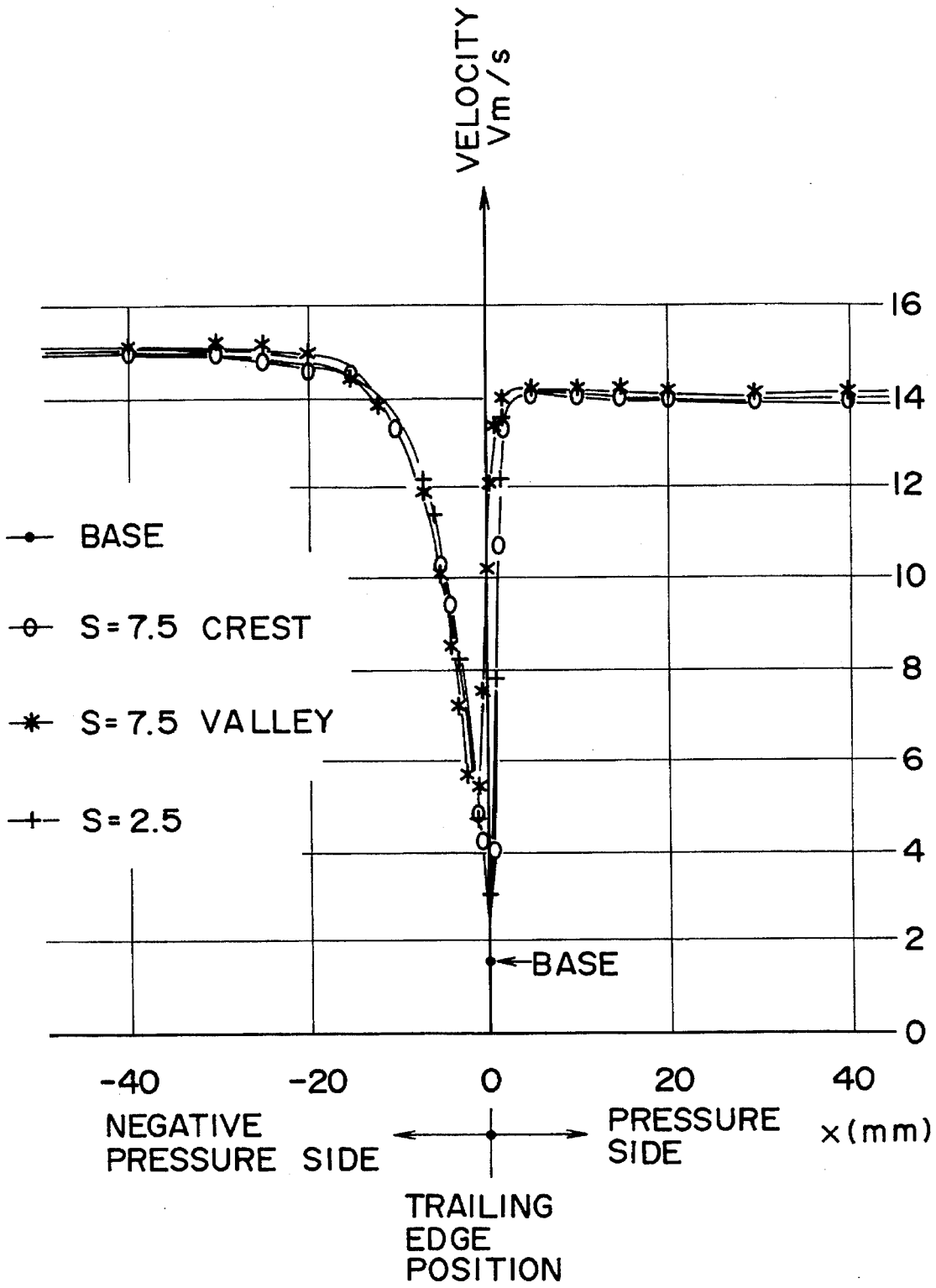
FIG. 8 is a characteristic diagram of velocity in relation to the change in shape of sawtooth.
Figure 9:
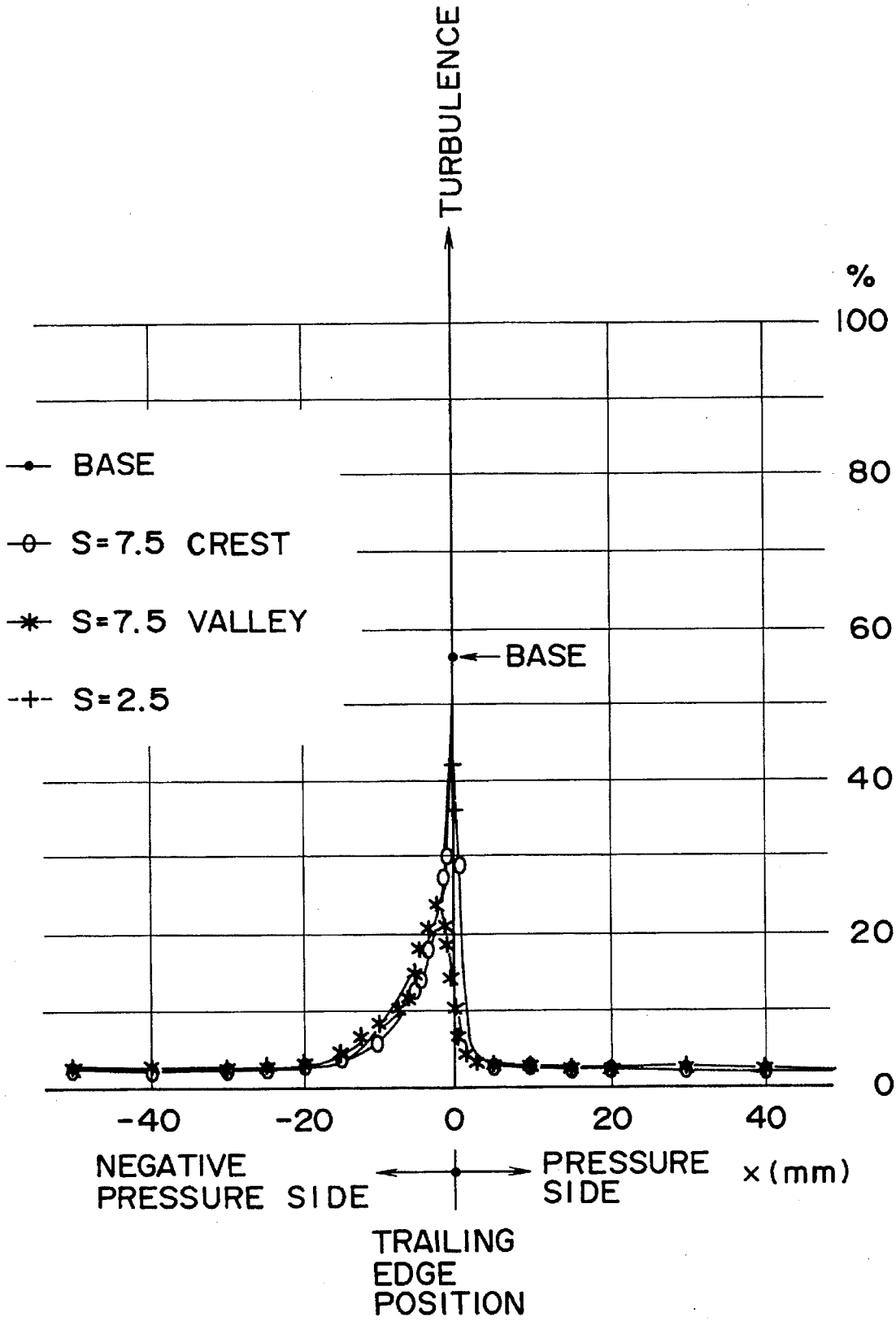
FIG. 9 is a characteristic diagram of turbulence in relation to the change in shape of sawtooth.

FIGS. 8 and 9 show the shape change characteristics of sawtooth. FIG. 8 shows the velocity characteristics, while FIG. 9 shows the turbulence characteristics. In these figures, the velocity (m/s) and turbulence (%) at the crest and the valley at the blade trailing edge are shown with respect to distance X from the surface of blade when S=0, S=2.5, and S=7.5 under the condition of S/H=1 (signs + and − correspond to the positive pressure zone and the negative pressure zone, respectively. Refer to FIG. 9).

FIG. 8 reveals the following: The drop in velocity at the center position of blade trailing edge increases in the order of base, S=2.5, crest portion of S=7.5, and valley portion of S=7.5. After all, the figure shows that if valleys with S of some size, that is, notches are present, the drop in velocity decreases.

FIG. 9 reveals the following: The flow turbulence at the center position of blade trailing edge increases in the order of base, S=2.5, crest portion of S=7.5, and valley portion of S=7.5. After all, the figure shows that if valleys with S of some size, that is, notches are present, the flow turbulence decreases.

The above description is a conclusion obtained from the result of experiment performed under the condition of the propeller fan speed of $U_\infty$=14.5 m/s for the propeller fan dimensions of D=394 mm in dia, C=0.25 m, and S/H=1.0.

Next, the noise reduction characteristics were measured under the condition of the propeller fan speed of $U_\infty$=40–50 m/s for the propeller fan dimensions of D=320 mm in dia, C=0.10 m, and S/H=1.0. The result is shown in FIG. 11 by using symbol x together with the above result.

Figure 11:
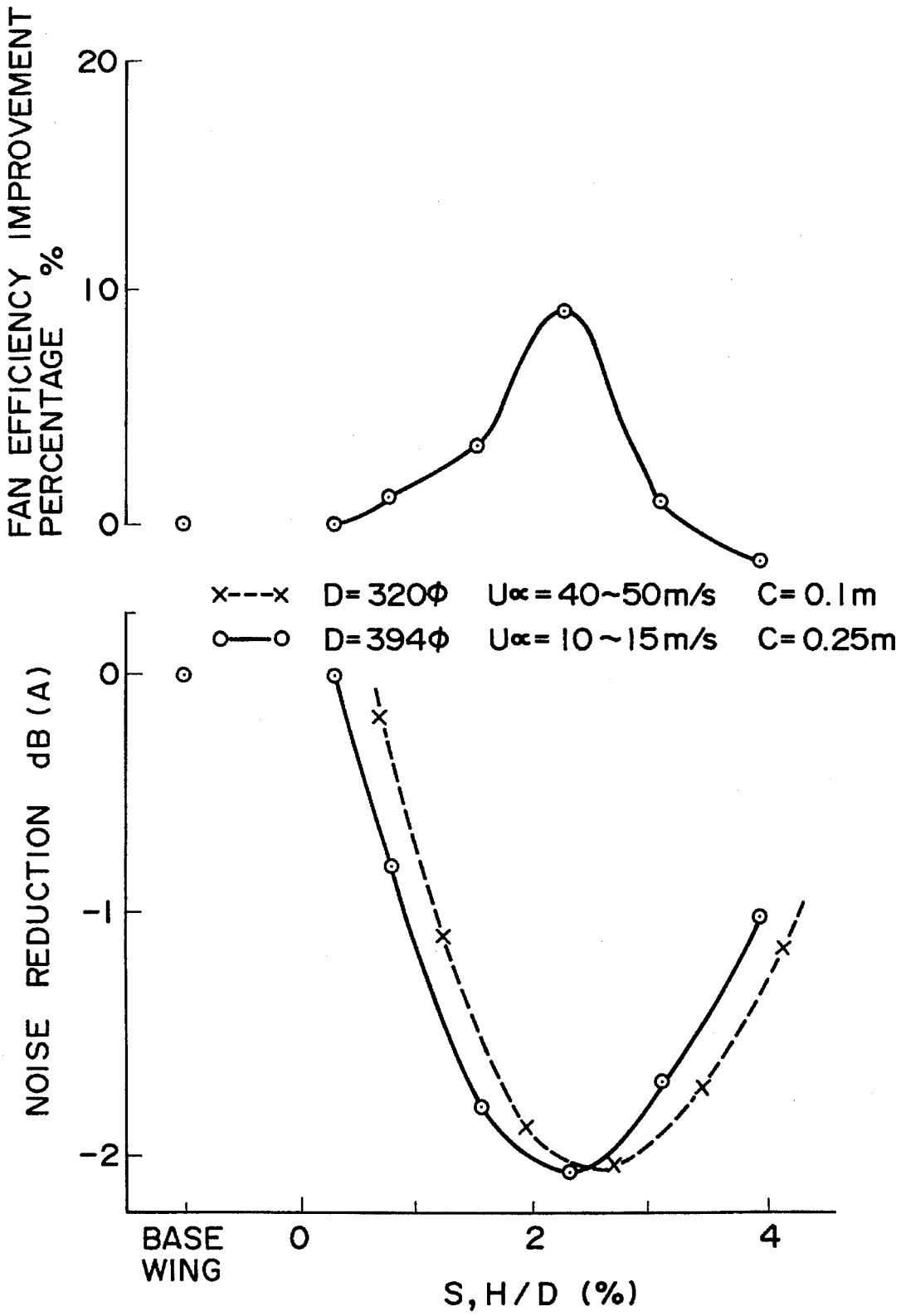
FIG. 11 is a characteristic diagram showing the effect of the size of tooth of blade trailing edge on the fan performance (noise reducing characteristics and fan efficiency characteristics)

FIG. 11 reveals the following:

(1) Regardless of the outside diameter D of the propeller fan 1, the noise reduction is at the minimum when S/D is nearly equal to 2–3% and H/D is nearly equal to 2–3%.

(2) Regarding the shape parameters of H and S of the sawtooth, although the above discussion has been given under the condition of S/H=1.0, considering that the reduction ranges of 1 dB(A) or more are 0.01<S/D and H/D<0.04, it is found that a reduction of 1 dB(A) or more can be expected if $0.5 \leqq S/H \leqq 2$.

When the blade trailing edge of the propeller fan is in a sawtooth shape as shown in FIG. 1, the tooth tip of sawtooth becomes sharp. Therefore, it is possible for noise to occur at the tip portion, and sink, burr, and the like are prone to be produced during the resin molding process.

Figure 12A:
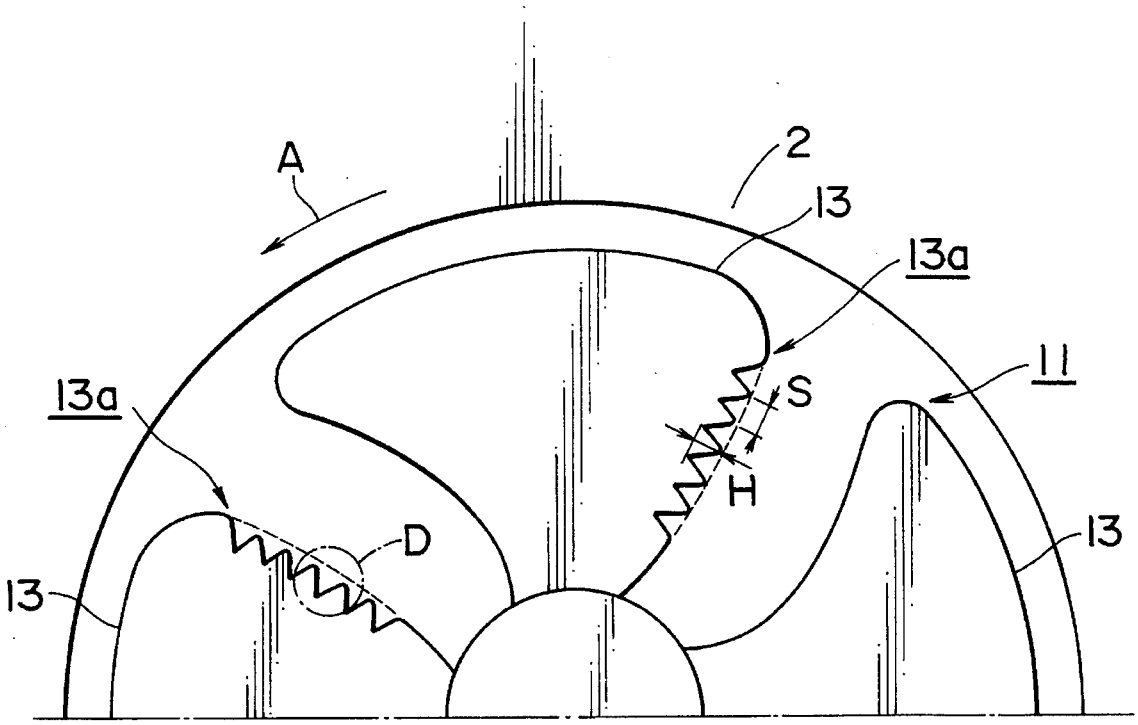
FIG. 12(*a*) is a configuration view showing the upper half of a propeller fan in accordance with another embodiment of the present invention, and FIG. 12(*b*) is an enlarged view of portion D.
Figure 12B:
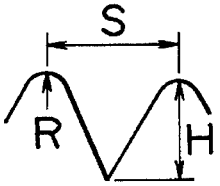

To solve these problems, the tooth tip of sawtooth is made round as shown in FIGS. 12(*a*) and 12(*b*) (FIG. 12(*a*) shows the upper half of a propeller fan, and FIG. 12(*b*) is an enlarged view of portion D in FIG. 12(*a*)).

That is to say, a propeller fan 11 shown in FIG. 12 has a plurality of blades 13 each of which has a trailing edge 13*a* of a sawtooth shape and has a tooth tip having a roundness of radius R.

Without a roundness at the tooth tip of sawtooth, the flow has a singular point at the tooth tip, so that noise is easily produced because of a suddenly joined flow or the generation of local secondary flow.

On the other hand, with a roundness at the tooth tip of sawtooth, the singularity of the flow is eliminated, so that the generation of noise is reduced. Also, the roundness at the tooth tip can restrict the production of sink, burr, and the like in the resin molding process due to the improvement in cooling of mold.

Figure 13:
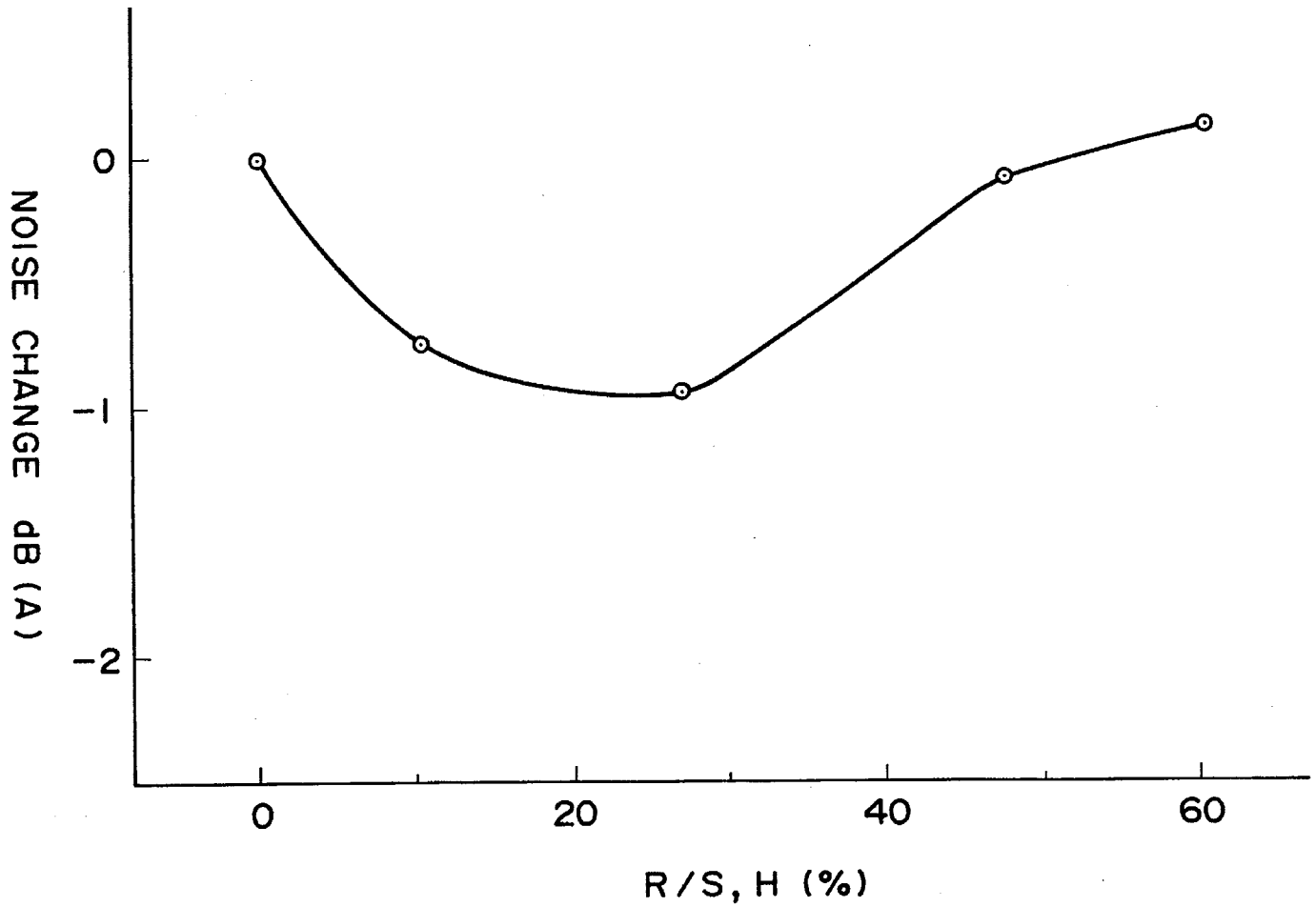
FIG. 13 is a characteristic diagram showing the effect of the roundness of sawtooth tip on the fan noise.

FIG. 13 is a characteristic diagram showing the effect of the roundness parameter (R/S, H) at the tooth tip on fan noise when S/D=H/D=0.02 where the noise is lowest in the propeller fan 11 and the fan efficiency is also improved. From FIG. 13, it is found that the noise is reduced when R/S or R/H is about 50% or less, and preferably less than 30% and greater than 10%, as compared with the case where the tooth tip is sharp (R=0).

As described above, according to the propeller fan 1 or 11 in accordance with this embodiment, the noise can further be reduced and the fan efficiency can be enhanced as compared with the conventional propeller fan 1', and additionally the practical use can be made easy.

Further, according to the propeller fan 11, the noise can further be reduced by rounding the tooth tip of sawtooth as compared with the case where the tooth tip is sharp, and additionally the production of sink, burr, and the like can be reduced when the propeller fan is molded.

Although the blade trailing edge is in a sawtooth shape having continuous teeth of the same shape in this embodiment, the saw tooth shape is not limited to this shape. A sawtooth shape having teeth of sequentially changed size from a larger tooth to a smaller tooth may be used, or a sawtooth shape having teeth with different angles combined appropriately may be used. Also, the tooth tips of various sawteeth may be rounded.

We claim:

1. A propeller fan having a blade trailing edge of a sawtooth shape, wherein $0.01<H/D<0.04$ and $0.01<S/D<0.04$, where H is a tooth height, S is a tooth pitch, and D is a diameter of the propeller fan.

2. The propeller fan according to claim 1, wherein the sawteeth are in a triangular shape.

3. The propeller fan according to claim 1, wherein tooth tips of the sawteeth are rounded, and the roundness of one of said tooth tips has a radius R in the range of $R/S\leqq 50\%$ or in the range of $R/H\leqq 50\%$.

4. The propeller fan according to claim 3, wherein the radius R is in the range of $10\%<R/S<30\%$ or is in the range of $10\%<R/H<30\%$.

5. The propeller fan according to claim 1, wherein $0.5\leqq S/H\leqq 2$.

6. A propeller fan having a blade trailing edge of a sawtooth shape having continuous teeth in the same shape, wherein $0.01<H/D<0.04$ and $0.01<S/D<0.04$, where H is a tooth height, S is a tooth pitch, and D is a diameter of the propeller fan.

7. The propeller fan according to claim 2, wherein the tooth tips of the sawteeth are rounded.

8. The propeller fan according to claim 6, wherein the sawteeth are in a triangular shape.

9. The propeller fan according to claim 6, wherein $0.5\leqq S/H\leqq 2$.

10. The propeller fan according to claim 6, wherein tooth tips of the sawteeth are rounded, and the roundness of one of said tooth tips has a radius R in the range of $R/S\leqq 50\%$ or in the range of $R/H\leqq 50\%$.

11. A propeller fan having a blade trailing edge of a sawtooth shape having teeth of a sequentially changed size from a larger tooth to a smaller tooth, wherein $0.5\leqq S/H\leqq 2$, $0.01<H/D<0.04$ and $0.01<S/D<0.04$, where D is the propeller fan diameter, H is a tooth height and S is a tooth pitch.

12. The propeller fan according to claim 11, wherein the sawteeth are in a triangular shape.

13. The propeller fan according to claim 11, wherein tooth tips of the sawteeth are rounded, and the roundness of one of said tooth tips has a radius R in the range of $R/S\leqq 50\%$ or in the range of $R/H\leqq 50\%$.

14. A propeller fan having a blade trailing edge of a sawtooth shape having teeth with different angles combined together, wherein $0.5\leqq S/H\leqq 2$, $0.01<H/D<0.04$ and $0.01<S/D<0.04$, where D is the propeller fan diameter, H is a tooth height and S is a tooth pitch.

15. The propeller fan according to claim 14, wherein the sawteeth are in a triangular shape.

16. The propeller fan according to claim 14, wherein tooth tips of the sawteeth are rounded, and the roundness of one of said tooth tips has a radius R in the range of $R/S\leqq 50\%$ or in the range of $R/H\leqq 50\%$.

* * * * *